United States Patent [19]

Williams

[11] 3,932,317

[45] Jan. 13, 1976

[54] COMPOSITIONS FOR REMOVING ACRYLIC BASED COATINGS

[75] Inventor: Ralph P. Williams, Bartlesville, Okla.

[73] Assignee: Phillips Petroleum Company, Bartlesville, Okla.

[22] Filed: Sept. 17, 1973

[21] Appl. No.: 398,063

[52] U.S. Cl. ..... 252/541; 134/40; 252/89; 252/DIG. 8

[51] Int. Cl.[2].. C11D 1/58; C11D 1/755; C11D 7/32

[58] Field of Search ..... 252/541, 523, 549, DIG. 8, 252/89; 134/40

[56] References Cited

UNITED STATES PATENTS

| | | | |
|---|---|---|---|
| 2,461,340 | 2/1949 | Morris et al. | 252/549 X |
| 2,482,631 | 9/1949 | Morris et al. | 252/549 X |
| 3,553,143 | 1/1971 | Bauer | 252/523 X |
| 3,703,472 | 11/1972 | Shaw et al. | 252/523 X |

*Primary Examiner*—Thomas J. Herbert, Jr.
*Attorney, Agent, or Firm*—Neuman, Williams, Anderson & Olson

[57] ABSTRACT

Compositions useful for removing or stripping acrylic based coatings, such as acrylic floor waxes, comprising ammonia, a surfactant and water-soluble sulfolanes.

4 Claims, No Drawings

COMPOSITIONS FOR REMOVING ACRYLIC BASED COATINGS

This invention relates to compositions useful for removing or stripping acrylic based coatings from surfaces.

During recent years acrylic based floor waxes have been developed and the use of such waxes is becoming more popular. At times it is desired to remove such coating compositions from surfaces on which they have been applied and it is to this problem that the present invention is directed. Acrylic coatings, especially floor waxes, are generally polyacrylates or copolymers of acrylates and acrylic acid in a water based formulation. These form transparent films after solvent evaporation which range from relatively soft to harder cross-linked films for high traffic applications. To remove these films, powerful detergents are often required which may adversely affect the base to which these acrylic coatings have been applied.

The present invention provides compositions which are effective for removing or stripping acrylic coating compositions from floors or other surfaces. The stripping compositions of this invention comprise ammonia, a sulfolane compound and a minor amount of a surfactant. Optionally and preferably, a small amount of an inorganic alkaline salt is also present in the composition. Such compositions can be readily diluted with water and used in known manner to remove acrylic based coatings from floors or other surfaces.

Illustratively, applicant's stripping compositions comprise the following components:

| | Wt. % |
|---|---|
| Sulfolane | 70–93 |
| Ammonia (aqua) about 29% by weight $NH_3$ concentration or concentrated $NH_4OH$* | 5–25 |
| Surfactant | 1–2 |
| Inorganic Alkaline Salt | 0–1 |

*Commercial concentrated ammonium hydroxide ($NH_4OH$) contains a minimum of 28.5 Weight percent $NH_3$ and a maximum 30 weight percent $NH_3$.

The sulfolane compounds employed in applicant's stripping composition include sulfolane itself and derivatives thereof which are water soluble, by which is meant those sulfolane compounds that result in a single phase when the stripping concentrate is diluted with water. These sulfolanes may be represented by the following formula:

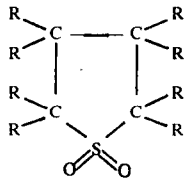

wherein each R is hydrogen or alkyl of 1 to 2 carbon atoms or alkoxy of 1 to 2 carbon atoms and wherein at least five of the R groups are hydrogen.

In addition to sulfolane, the following alkyl, alkoxy or alkyl/alkoxy substituted derivatives of sulfolane can be used: 3-methylsulfolane, 3,4-diethylsulfolane, 2,5-dimethylsulfolane, 3-methoxysulfolane, 2,4-dimethyl-3-methoxysulfolane, 2,4-dimethyl-4-ethoxysulfolane, 3,4-diethoxysulfolane, 2-methoxy-3-ethylsulfolane, 3,3-dimethylsulfolane, 2,2-diethylsulfolane and the like.

A wide variety of nonionic and anionic surface active agents can be employed in the stripping composition of this invention. It is generally preferred to employ a 50/50 mixture of nonionic and anionic surfactants. These can be chosed from standard reference materials listing various available surfactants. The principal criteria for usefulness is the compatibility of the surfactants with the other components of the composition and the stability imparted. Compatibility and stability can be determined by simple testing of compositions formulated with a particular surfactant. By compatibility and stability is meant that the resultant concentrate comprises a single phase, homogeneous mixture, stable at temperatures normally encountered in the home, i.e. 40–110°F. and which, when diluted with water as disclosed herebelow, will form a single phase, homogeneous acrylic wax removing solution. In the alternative, the nonionic surfactants can be chosen on the basis of their HLB value with those nonionic surfactants having an HLB value between 10 and 18 being suitable and the preferred HLB value being between about 14 and 17. The HLB value of an emulsifier or surfactant is an expression of its Hydrophile-Lipophile Balance, i.e., the balance of the size and strength of the hydrophilic (water-loving or polar) and the lipophilic (oil-loving or non-polar) groups of the emulsifier. All emulsifiers consist of a molecule that combines both hydrophilic and lipophilic groups. Surfactants or emulsifiers having an HLB value of about 10 to 18 are oil-in-water emulsifiers, with those having an HLB value between about 10 and 18 functioning as solubilizers and those having an HLB value of about 13 to 15 functioning as detergents. The HLB value of nonionic surfactants, if not specified by the supplier, can be readily calculated by methods known to the art, such as methods described, for example, on pages 18 and 19 in the publication entitled "The Atlas HLB System", published by Atlas Chemical Industries, Inc., copyright 1963. Representative suitable nonionic surfactants include polyoxyethylene sorbitan monolaurate (HLB 16.7), polyoxyethylene sorbitan monooleate (HLB 15.0), polyoxyethylene lauryl ether (HLB 16.9), polyoxyethylene cetyl ether (HLB 15.7), polyoxyethylene sorbitan monopalmitate (HLB 15.6) and the like.

Useful anionic surfactants include alkali metal salts of alkyl-sulfuric acids, $RSO_4H$, where R is an aliphatic radical having 8–18 carbon atoms, such as sodium 2-ethylhexylsulfate, sodium laurylsulfate, potassium octadecyl sulfate, sodium stearyl sulfate, sodium tridecanyl sulfate and the like. Compatible mixtures of surfactants can be employed.

In addition to ammonia, a sulfolane and surfactant it is preferred, but not necessary, to employ in the stripping composition a small amount, i.e. up to about 1%, of an inorganic alkaline salt such as those currently employed as "builders" in detergent compositions. Such include alkali metal carbonates, borates, phosphates, polyphosphates, bicarbonates and silicates. Inorganic phosphate salts, such as alkali metal tripolyphosphates and higher condensed phosphates, are particularly preferred since in addition to providing alkalinity for detergency, they serve as water softening agents by chelating or sequestering magnesium and calcium ions present in hard water. Representative alkaline detergent salts which can be optionally employed in the stripping compositions, based on experience of those skilled in the art, are sodium carbonate, sodium bicarbonate, sodium metasilicate, sodium borate, sodium perborate, di-, tri- and monosodium orthophosphates, sodium sesquicarbonate, potassium carbonate, sodium hydroxide, potassium hydroxide, sodium sesquisilicate, sodium orthosilicate, potassium bicarbonate, potassium silicates, alkaline condensed phosphate salts such as tetrasodium pyrophosphate or tetrapotassium pyrophosphate and polyphosphates such as sodium tripolyphosphate.

In use the stripping compositions are diluted with water and applied to a surface bearing an acrylic base coating. Dilutions of about 1 part stripping composition (concentrate) to 5–12 parts of water, and preferably about 8 to 10 parts of water, can be used satisfactorily. The stripping composition asserts a solubilizing effect on the acrylic base coating which permits it to be removed by simple mopping or scrubbing. The diluted stripping composition is permitted to remain on the surface to be stripped for several minutes, such as 5 to 15 minutes, and then removed. If necessary, the stripping composition can be reapplied one or more times to complete the stripping.

The advantages of the invention will be further apparent from consideration of the following example.

EXAMPLE

A number of formulations were made up as shown in Table I. Each formulation was diluted 1 part with about 8 parts of warm water and applied to a linoleum floor which had been waxed repeatedly over a six month period with an acrylic wax (Johnson's Future). The diluted cleaning solutions were allowed to stand on the floor for about 10 minutes and were then removed with a wet mop. The results are in Table I.

Table I

| Formulation No.** | Sulfolane | Ammonia* | Dilution Water | Wax Removal Ability |
|---|---|---|---|---|
| 1 | 83 g | 15 g | 800 g | Excellent — Complete removal |
| 2 | 88 g | 10 g | 800 g | Excellent — Complete removal |
| 3 | 93 g | 5 g | 800 g | Good — mostly removed |
| 4 | 97 g | 1 g | 800 g | Poor — none removed |
| 5 | 98 g | 0 g | 800 g | Poor — none removed |

*About 29% aqueous solution (Commercial concentrated ammonium hydroxide ($NH_4OH$) contains a minimum of 28.5 weight percent $NH_3$ and a maximum 30 weight percent $NH_3$).

**All formulations contained 1 g sodium tripolyphosphate and 1 g of a surfactant composition of 50% by weight (polyoxyethylene sorbitan monooleate) (60% by weight) and polyoxyethylene sorbitan monooleate (40% by weight) (HLB 16) and 50% by weight sodium lauryl sulfate.

Those modifications and equivalents which fall within the spirit of the invention are to be considered a part thereof.

What is claimed is:

1. A composition useful for dilution with water to remove acrylic based coating compositions which comprises from about 5–25% by weight of concentrated aqueous ammonia, from 1 to 2% by weight of an organic surface active agent, from 0–1% by weight of an inorganic alkaline salt and from about 70–93% by weight of a sulfolane compound having the formula:

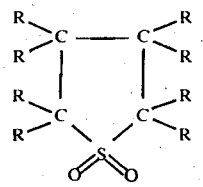

wherein each R is hydrogen or alkyl of 1 to 2 carbon atoms or alkoxy of 1 to 2 carbon atoms and wherein at least five of the R groups are hydrogen.

2. A composition in accordance with claim 1 wherein the sulfolane compound is sulfolane itself.

3. A method of removing acrylic based coating compositions which comprises contacting said acrylic based coating compositions with an aqueous solution of a composition comprising from about 5–25% by weight of concentrated aqueous ammonia, from 1 to 2% by weight of an organic surface active agent, from 0–1% by weight of an inorganic alkaline salt and from about 70–93% by weight of a sulfolane compound having the formula:

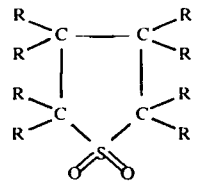

wherein each R is hydrogen or alkyl of 1 to 2 carbon atoms or alkoxy of 1 to 2 carbon atoms and wherein at least five of the R groups are hydrogen.

4. A method in accordance with claim 3 wherein the sulfolane compound is sulfolane itself.

* * * * *